US009109792B2

(12) United States Patent
Yang

(10) Patent No.: US 9,109,792 B2
(45) Date of Patent: Aug. 18, 2015

(54) SWITCH ILLUMINATION DEVICE

(71) Applicant: Hsiu-Ling Yang, Tauyuan (TW)

(72) Inventor: Hsiu-Ling Yang, Tauyuan (TW)

( * ) Notice: Subject to any disclaimer, the term of this patent is extended or adjusted under 35 U.S.C. 154(b) by 407 days.

(21) Appl. No.: 13/693,643

(22) Filed: Dec. 4, 2012

(65) Prior Publication Data

US 2014/0153229 A1 Jun. 5, 2014

(51) Int. Cl.
*F21L 4/00* (2006.01)
*F21V 33/00* (2006.01)
*H01H 9/18* (2006.01)

(52) U.S. Cl.
CPC ..... *F21V 33/0076* (2013.01); *F21L 4/005* (2013.01); *H01H 9/182* (2013.01); *F21V 33/006* (2013.01)

(58) Field of Classification Search
CPC ..... F21L 4/005; F21L 4/00; F21V 33/006; F21V 33/0076; H01H 9/182
USPC ..... 362/95, 217.12, 217.16, 191
See application file for complete search history.

(56) References Cited

U.S. PATENT DOCUMENTS 7,581,844 B1 * 9/2009 Yang ..... 362/95

* cited by examiner

*Primary Examiner* — Sharon Payne
(74) *Attorney, Agent, or Firm* — Locke Lord LLP; Tim Tingkang Xia, Esq.

(57) ABSTRACT

A switch illumination device positioned outside a switch is introduced. The switch illumination device includes a switch panel, a light-emitting unit, and a fastening and unfastening structure. The switch illumination device further includes a fastening and unfastening structure whereby the light-emitting unit is coupled to switch panel. Hence, the light-emitting unit can not only be fixed to the switch panel but also be removed therefrom, thereby effectuating nocturnal illumination, emergency illumination, and mobile illumination.

4 Claims, 12 Drawing Sheets

150

150'

100'

150"

SWITCH ILLUMINATION DEVICE

FIELD OF THE INVENTION

The present invention relates to switch illumination devices, and more particularly, to a switch illumination device comprising a movable light-emitting unit.

BACKGROUND OF THE INVENTION

In general, a typical power switch is seldom equipped with a light source, thereby preventing users from locating the power switch in their unilluminated surroundings. To overcome this drawback of the prior art, two solutions are in used. Either the users grope for the power switch in their unilluminated surroundings, or the button or key of the power switch is equipped with a dim light-emitting element whereby the users locate the power switch in their unilluminated surroundings. However, in case of a need of a light source strong enough to serve an illuminative purpose other than just locating the power switch, the light-emitting element proves unfit for such a purpose and thus has to be replaced with a night lamp, a flashlight, or any other illumination device.

A power outage usually brings about an urgent need of illumination. A conventional emergency lighting is typically positioned high on the wall and thus is hardly accessible. Furthermore, the conventional emergency lighting is bulky and thus rarely portable. As a result, illumination provided by the conventional emergency lighting is restricted to a specific point and a specific angle. Furthermore, a flashlight is a commoner emergency illumination device for use in households than the conventional emergency lighting is. However, unlike the conventional emergency lighting whose position is always fixed, the aforesaid standby flashlight has a drawback, that is, its position is variable and thus forgettable.

Accordingly, it is imperative to provide a switch illumination device that overcomes the aforesaid drawbacks of the prior art, namely the difficulty in locating a power switch in unilluminated surroundings, the lack of portability of a conventional emergency lighting, and the high chance of forgetting the location of a standby flashlight.

SUMMARY OF THE INVENTION

It is an objective of the present invention to provide a switch illumination device whereby a light-emitting unit is firmly mounted on a switch panel and can be readily dismounted from the switch panel, so as to effectuate nocturnal illumination, emergency illumination, and mobile illumination.

In order to achieve the above and other objectives, the present invention provides a switch illumination device positioned outside a switch. The switch illumination device comprises a switch panel, a light-emitting unit, and a fastening and unfastening structure. The switch panel has a receiving chamber, a first through hole, a second through hole, a third through hole and at least a first resilient element. The at least a first resilient element is fixed inside the receiving chamber. The switch is exposed from the switch panel through the first through hole. The light-emitting unit is movably disposed inside the receiving chamber. The light-emitting unit has a positioning recess, a first end surface, and a second end surface opposing the first end surface. The second end surface abuts against the at least a first resilient element. The first end surface is exposed from the switch panel through the second through hole. The positioning recess is disposed between the first end surface and the second end surface. The fastening and unfastening structure is disposed at the receiving chamber. The fastening and unfastening structure has an engaging element, a second resilient element and a pressing element. The engaging element has a protruding portion corresponding in position to and disposed at the positioning recess. The second resilient element is connected between the switch panel and the engaging element. The pressing element abuts against the engaging element and is exposed from the switch panel through the third through hole.

In an embodiment, the receiving chamber has therein a first spindle and a first stop portion. The engaging element is divided into a first section, a first engaging portion, and a second section in sequence. The first engaging portion is movably disposed at the first spindle. The protruding portion is disposed at the first section. The pressing element abuts against the second section. The second resilient element is connected between the first section and the first stop portion.

In an embodiment, the receiving chamber has therein a second spindle and a third spindle. The engaging element is divided into a first section, a first engaging portion, and a second section in sequence. The first engaging portion is movably disposed at the second spindle. The protruding portion is disposed at the first section. The pressing element abuts against the second section. The second resilient element is a C-shaped element having one end defined as a second engaging portion disposed at the third spindle and having the other end connected to the second section.

In an embodiment, the receiving chamber has therein a second stop portion and a third stop portion. The engaging element is divided into a first section and a second section which together have a 7-shaped appearance. The protruding portion is disposed at the first section. The second section has a surface defined as an inclined surface and has another surface movably abutting against the second stop portion. The pressing element movably abuts against the inclined surface. The second resilient element is connected between the second section and the third stop portion.

Accordingly, a switch illumination device of the present invention comprises a fastening and unfastening structure whereby a light-emitting unit gets coupled to a switch panel, such that the light-emitting unit can be firmly disposed on the switch panel and easily dismounted from the switch panel, so as to effectuate nocturnal illumination, emergency illumination, and mobile illumination.

BRIEF DESCRIPTION OF THE DRAWINGS

Objectives, features, and advantages of the present invention are hereunder illustrated with specific embodiments in conjunction with the accompanying drawings, in which.

DETAILED DESCRIPTION OF THE PREFERRED EMBODIMENTS

Figure 1:
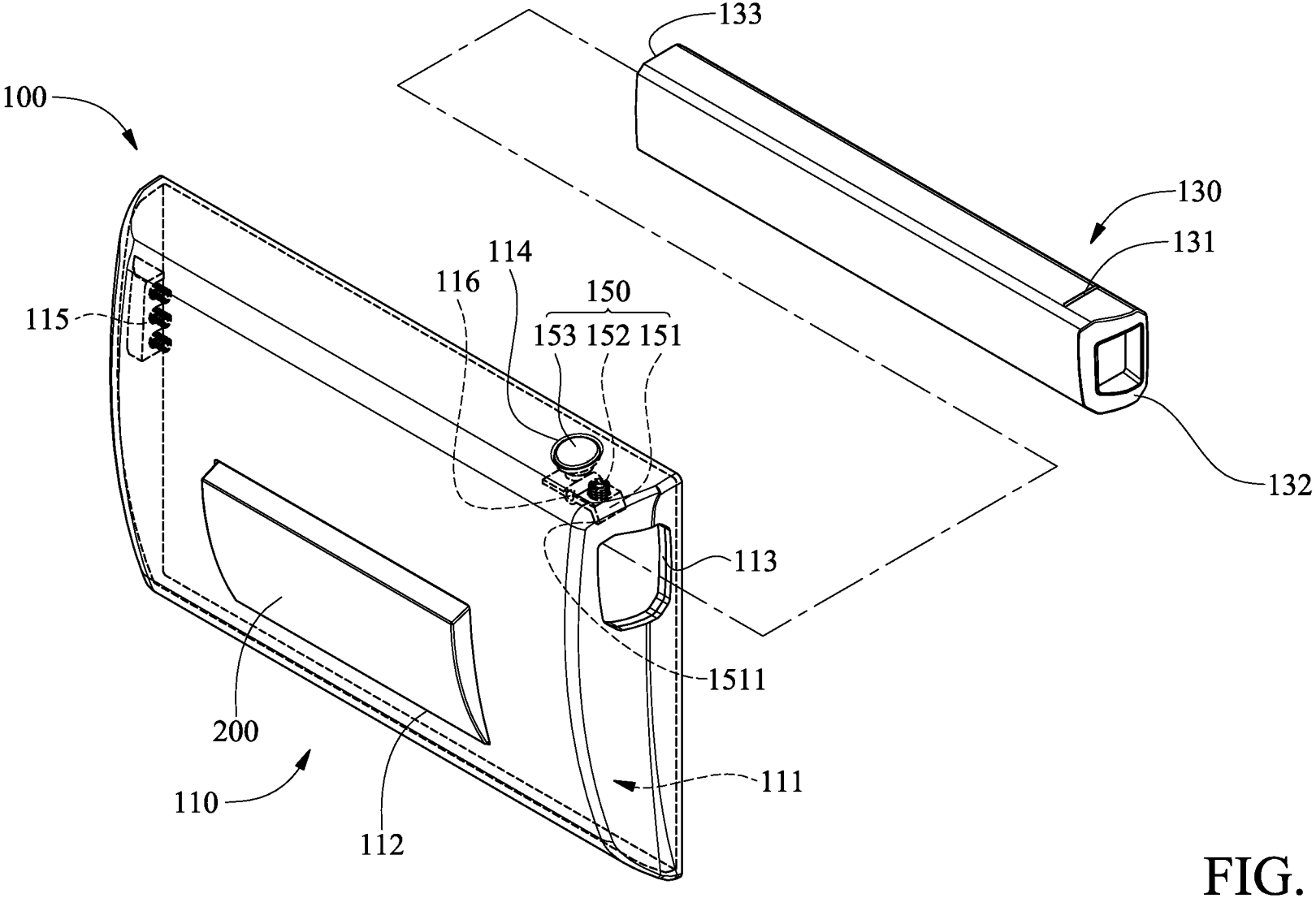
FIG. 1 is an exploded view of a switch illumination device positioned outside a switch according to the first specific embodiment of the present invention.
Figure 2:
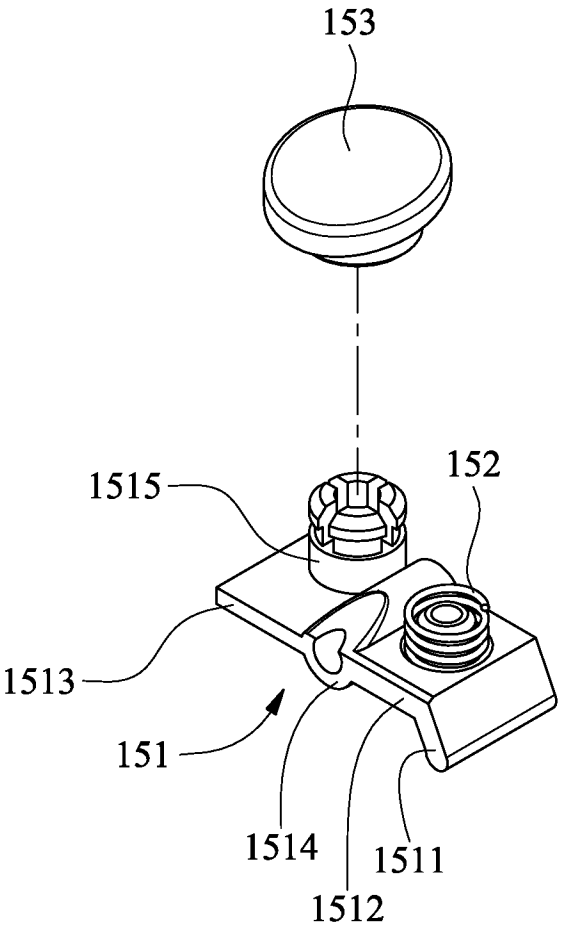
FIG. 2 is a perspective view of a fastening and unfastening structure of the switch illumination device according to the first specific embodiment of the present invention.
Figure 3:
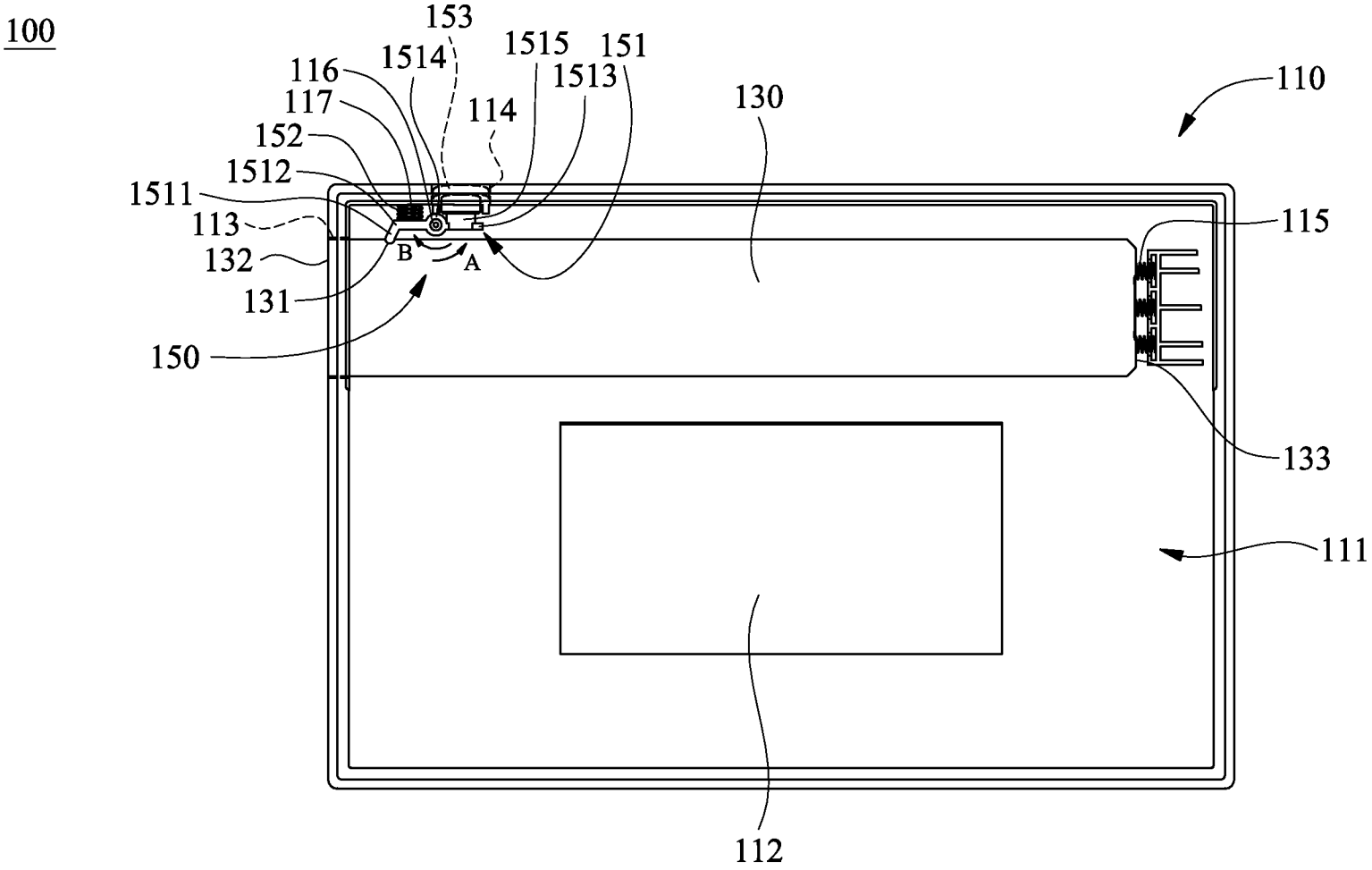
FIG. 3 is a schematic view of operation of the switch illumination device according to the first specific embodiment of the present invention.
Figure 4:
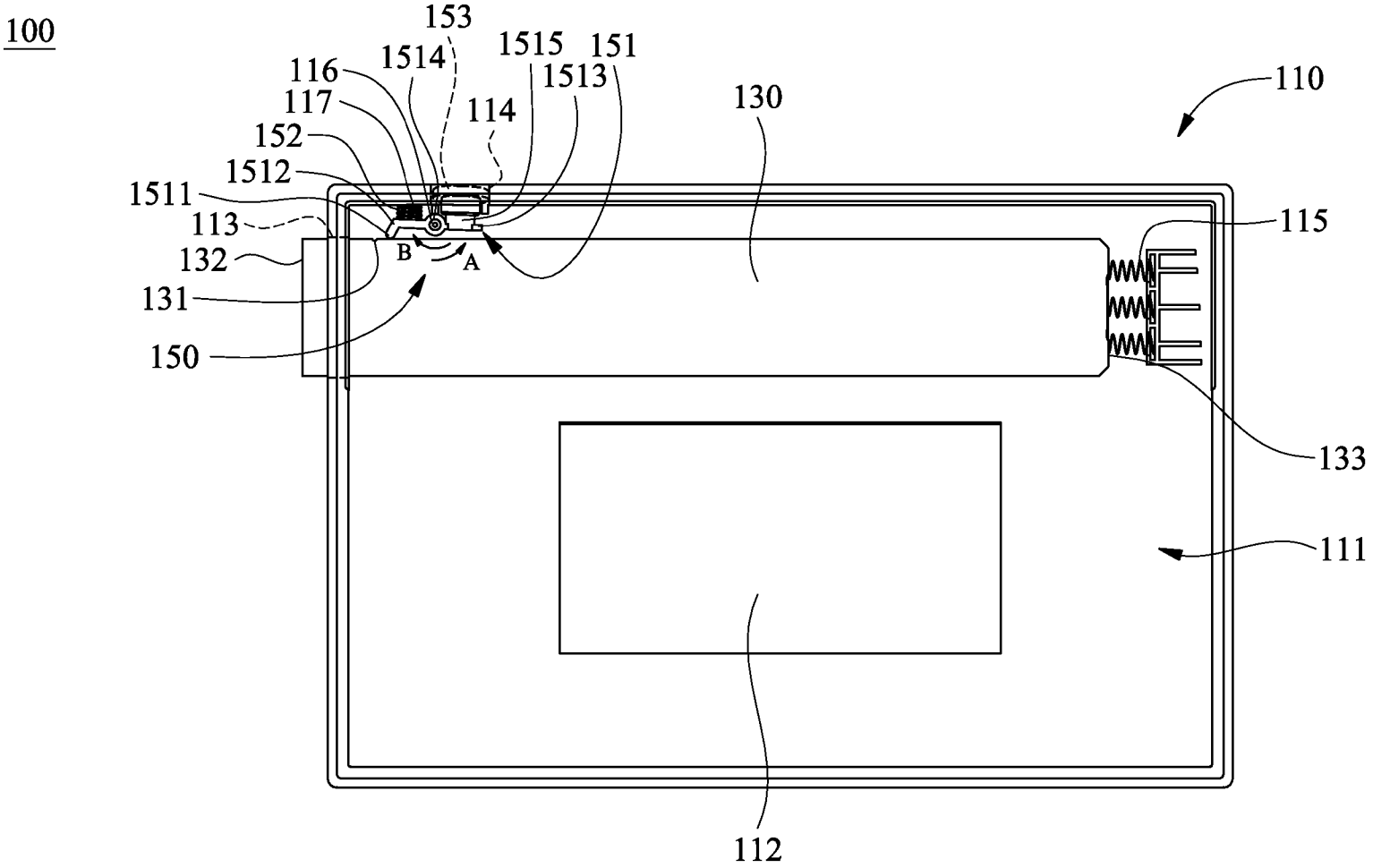
FIG. 4 is a schematic view of operation of the switch illumination device according to the first specific embodiment of the present invention.

Referring to FIG. 1 through FIG. 4, there are shown in FIG. 1 an exploded view of a switch illumination device positioned outside a switch according to the first specific embodiment of the present invention, in FIG. 2 a perspective view of a fastening and unfastening structure of the switch illumination device according to the first specific embodiment of the present invention, and in FIG. 3 and FIG. 4, schematic views of operation of the switch illumination device according to the first specific embodiment of the present invention. Referring to the above drawings, a switch illumination device 100 comprises a switch panel 110, a light-emitting unit 130, and a fastening and unfastening structure 150. The switch illumination device 100 is positioned outside a switch 200.

The switch panel 110 has a receiving chamber 111, a first through hole 112, a second through hole 113, a third through hole 114, and at least a first resilient element 115. The at least a first resilient element 115 is fixed inside the receiving chamber 111. The switch 200 is exposed from the switch panel 110 through the first through hole 112.

The light-emitting unit 130 is movably disposed inside the receiving chamber 111. The light-emitting unit 130 has a positioning recess 131, a first end surface 132, and a second end surface 133 opposite to the first end surface 132. The second end surface 133 abuts against the at least a first resilient element 115. The first end surface 132 is exposed from the switch panel 110 through the second through hole 113. The positioning recess 131 is disposed between the first end surface 132 and the second end surface 133. A light source disposed on the first end surface 132 or the second end surface 133 of the light-emitting unit 130 emits light to effectuate illumination. The light-emitting unit 130 is recharged by means of a power supply (not shown) connected to the switch 200.

The fastening and unfastening structure 150 is disposed in the receiving chamber 111 and positioned proximate to the light-emitting unit 130. The fastening and unfastening structure 150 has an engaging element 151, a second resilient element 152, and a pressing element 153. The engaging element 151 has a protruding portion 1511 corresponding in position to and disposed at the positioning recess 131. The second resilient element 152 is connected between the switch panel 110 and the engaging element 151. The pressing element 153 abuts against the engaging element 151 and is exposed from the switch panel 110 through the third through hole 114, so as to be subjected to a press given by a user.

Once the protruding portion 1511 of the engaging element 151 is engaged with and fixed to the positioning recess 131, the light-emitting unit 130 will be fixed inside the receiving chamber 111 and thus cannot be removed by the user. If the user presses the pressing element 153, the protruding portion 1511 of the engaging element 151 will be disconnected from the positioning recess 131. As a result, under a resilience restoring force exerted by the at least a first resilient element 115, the light-emitting unit 130 protrudes from the second through hole 113 and become available for use by the user. In this embodiment, the at least a first resilient element 115 are in the number of three to serve an exemplary purpose, and its quantity is subject to change as needed.

In this embodiment, the fastening and unfastening structure 150 is disposed above the light-emitting unit 130, and the positioning recess 131 is disposed above and lateral to the light-emitting unit 130. The receiving chamber 111 has therein a first spindle 116 and a first stop portion 117. The first stop portion 117 is defined as a lateral inner wall surface of the receiving chamber 111 and disposed above the fastening and unfastening structure 150. The engaging element 151 is divided into a first section 1512, a first engaging portion 1514, and a second section 1513 arranged in sequence. The first engaging portion 1514 is movably disposed at the first spindle 116 and adapted to enable the engaging element 151 to rotate about the first spindle 116. The protruding portion 1511 is disposed at the first section 1512. The pressing element 153 abuts against the second section 1513. The second resilient element 152 is connected between the first section 1512 and the first stop portion 117.

In this embodiment, the at least a first resilient element 115 is a spring fixed to an inner wall surface of the receiving chamber 111, whereas the second resilient element 152 is also a spring.

Furthermore, the engaging element 151 further comprises a connection portion 1515 being a portion of the pressing element 153 or a portion of the second section 1513. Hence, the connection portion 1515 is disposed at the second section 1513 of the engaging element 151 or the pressing element 153 for assisting the pressing element 153 in abutting against the second section 1513. In this embodiment, the connection portion 1515 is disposed above the second section 1513.

Referring to FIG. 3, to put the light-emitting unit 130 in the switch panel 110, the user inserts the light-emitting unit 130 into the receiving chamber 111 through the second through hole 113, keeps pushing the light-emitting unit 130 until the positioning recess 131 gets close to the protruding portion 1511; meanwhile, the second resilient element 152 exerts a resilience restoring force on the first section 1512 of the engaging element 151, such that the engaging element 151 rotates about the first spindle 116 in a first direction A (that is, anticlockwise as shown in FIG. 3) and the protruding portion 1511 is engaged with and fixed to the positioning recess 131. As a result, second end surface 133 of the light-emitting unit 130 abuts against and presses against the at least a first resilient element 115, such that the first end surface 132 is flush with the second through hole 113 of the switch panel 110, thereby preventing the first end surface 132 from protruding from the second through hole 113. At this point in time, the light-emitting unit 130 has got fixed to the switch panel 110.

Conversely, to take out the light-emitting unit 130, the user has to press the pressing element 153 to cause the pressing element 153 to abut against the second section 1513 of the engaging element 151, such that the engaging element 151 rotates about the first spindle 116 in a second direction B (that is, clockwise as shown in FIG. 3); meanwhile, the first section 1512 of the engaging element 151 presses against the second resilient element 152, and the protruding portion 1511 of the engaging element 151 is disconnected from the positioning recess 131. As a result, under a resilience restoring force exerted by the at least a first resilient element 115, the light-emitting unit 130 protrudes from the second through hole 113 in a manner shown in FIG. 4, thereby allowing the user to withdraw the light-emitting unit 130 from the switch panel 110 directly.

Figure 5:
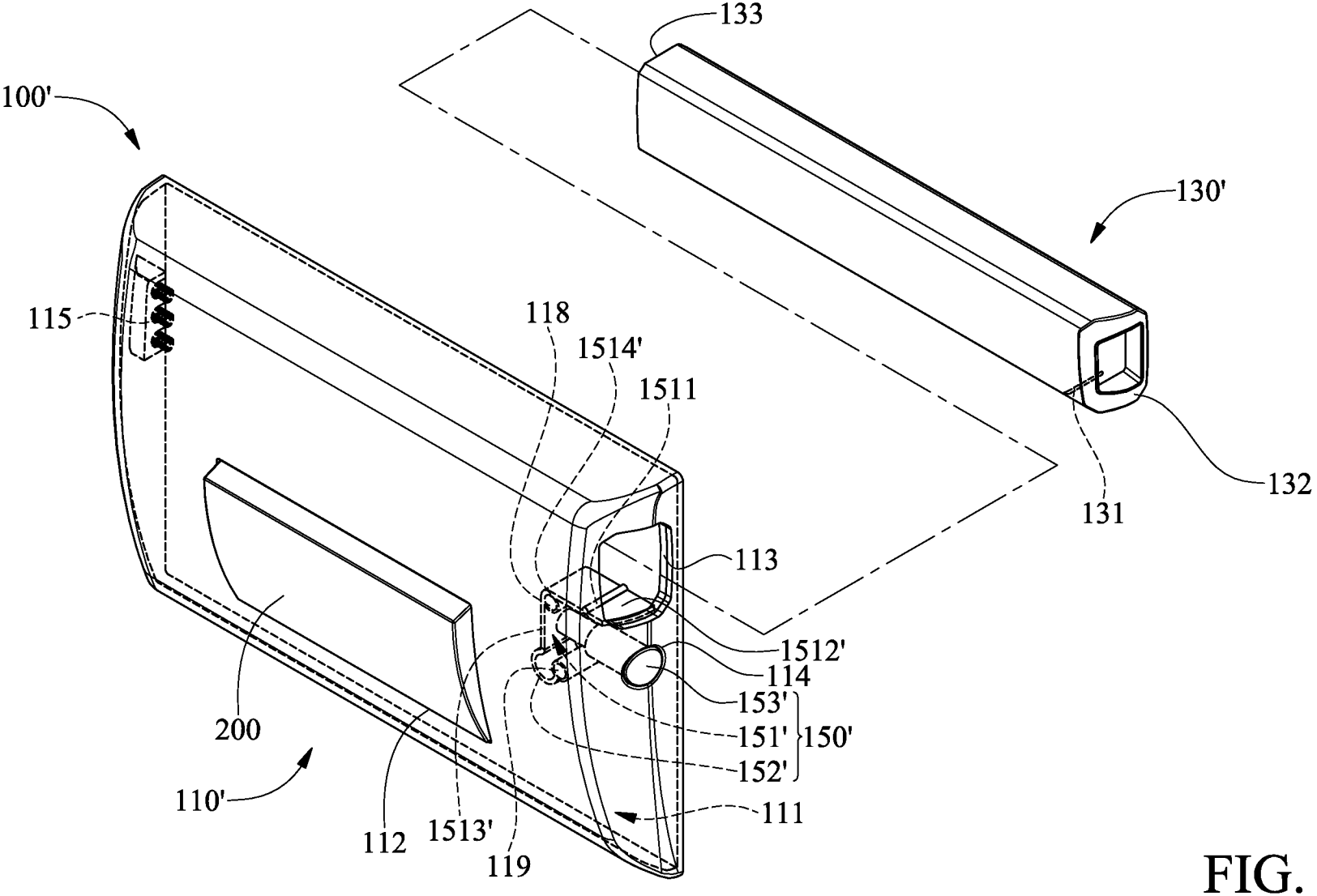
FIG. 5 is an exploded view of a switch illumination device positioned outside a switch according to a second specific embodiment of the present invention.
Figure 6:
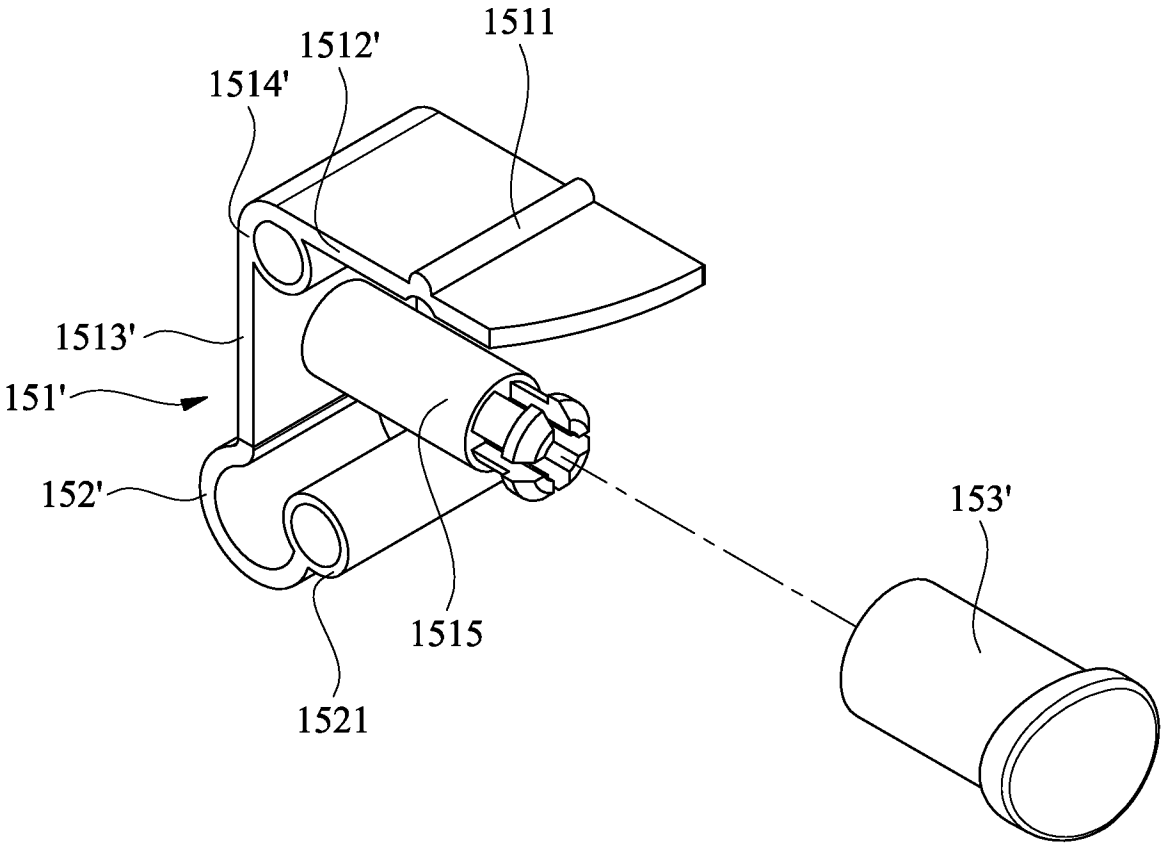
FIG. 6 is a perspective view of a fastening and unfastening structure of the switch illumination device according to the second specific embodiment of the present invention.
Figure 7:
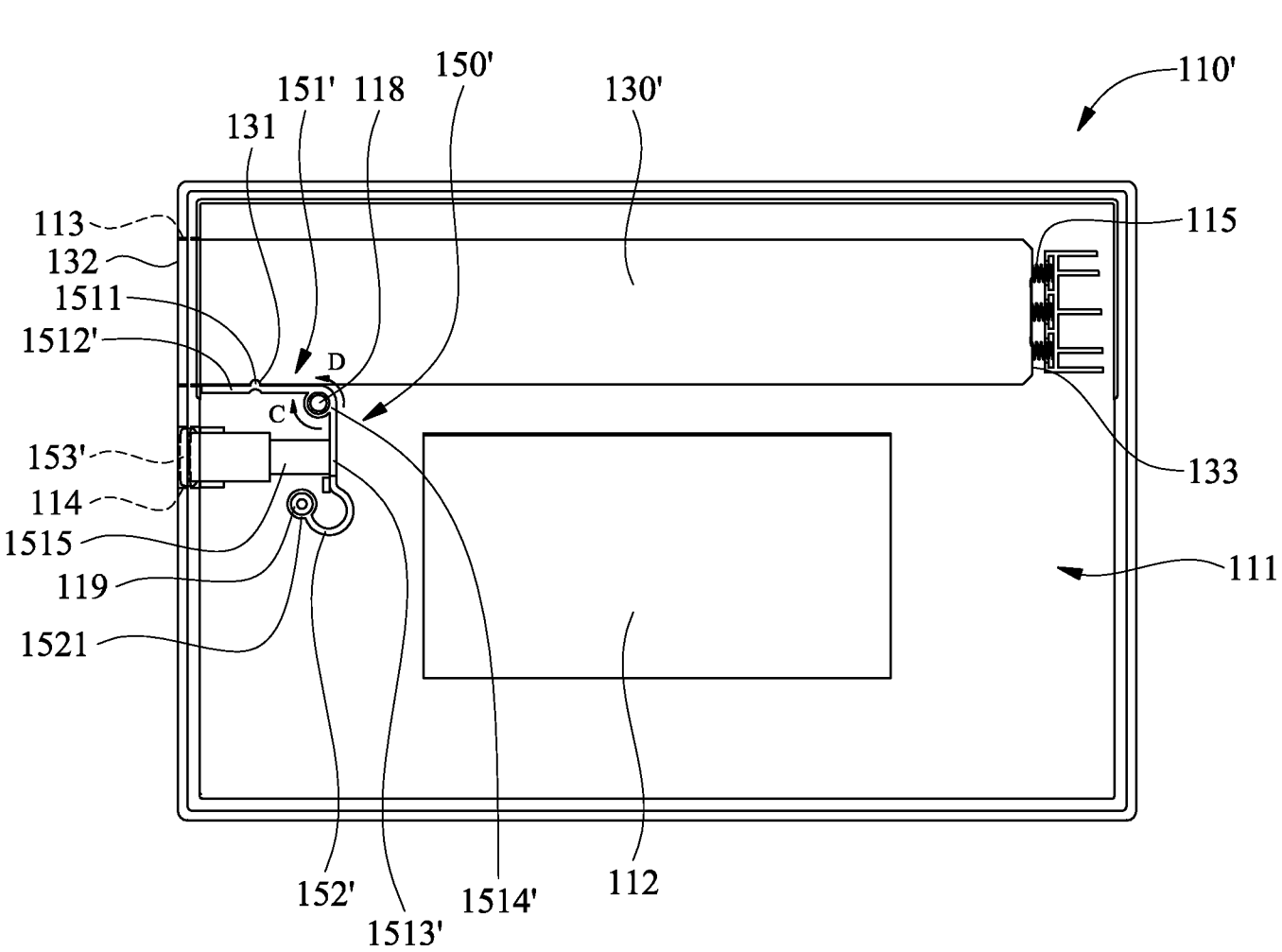
FIG. 7 is a schematic view of operation of the switch illumination device according to the second specific embodiment of the present invention.
Figure 8:
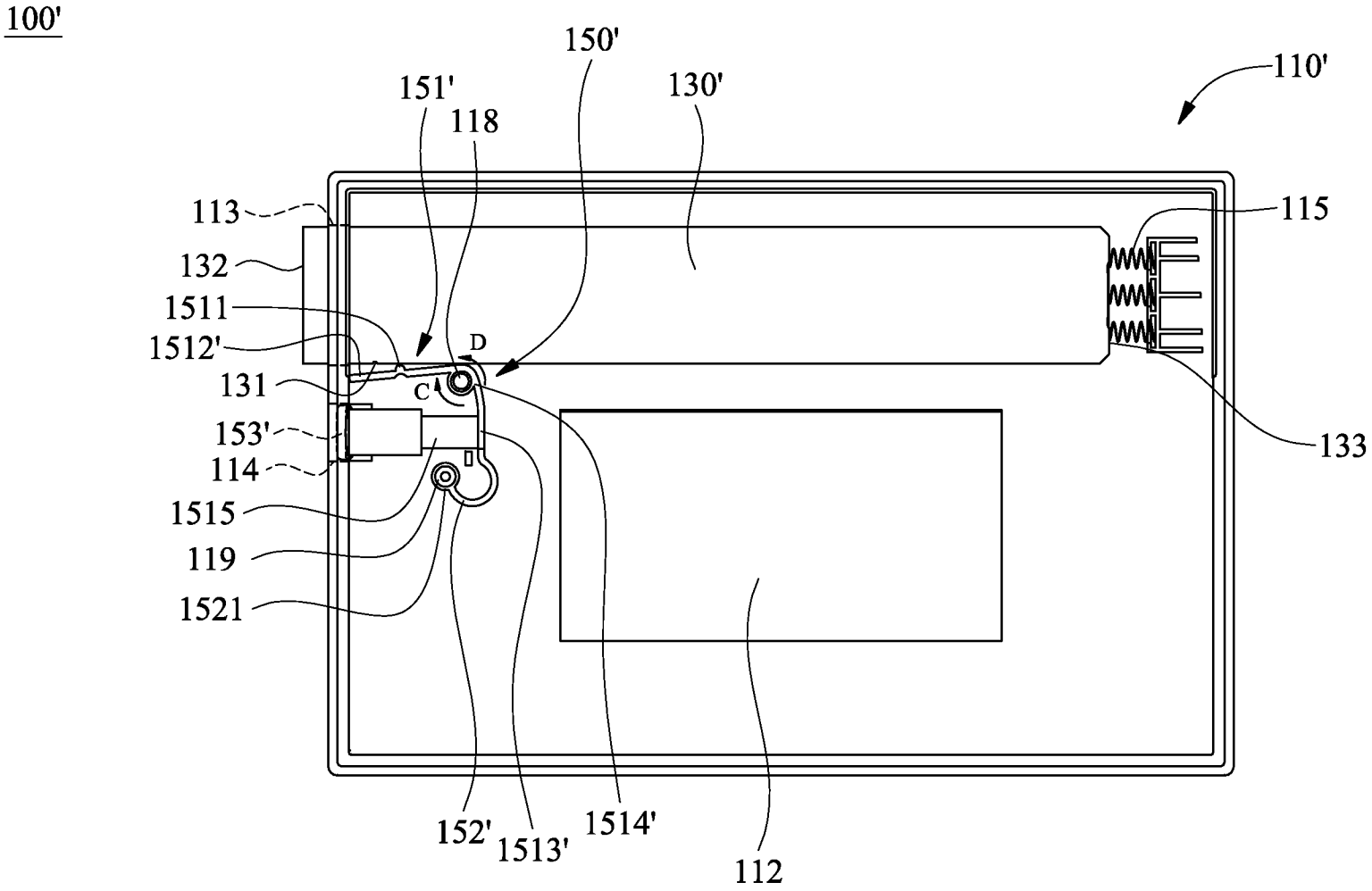
FIG. 8 is a schematic view of operation of the switch illumination device according to the second specific embodiment of the present invention.

Referring to FIG. 5 through FIG. 8, there are shown in FIG. 5 an exploded view of a switch illumination device positioned outside a switch according to a second specific embodiment of the present invention, in FIG. 6 a perspective view of a fastening and unfastening structure of the switch illumination device according to the second specific embodiment of the present invention, and in FIG. 7 and FIG. 8 schematic views of operation of the switch illumination device according to the second specific embodiment of the present invention. Referring to the above drawings, a switch illumination device 100' comprises a switch panel 110', a light-emitting unit 130', and a fastening and unfastening structure 150'. The fastening and unfastening structure 150' has an engaging element 151', a second resilient element 152', and a pressing element 153'.

In this embodiment, the fastening and unfastening structure 150' is disposed below the light-emitting unit 130', and the positioning recess 131 is disposed below and later to the light-emitting unit 130'. The receiving chamber 111 has therein a second spindle 118 and a third spindle 119. The engaging element 151' is divided into a first section 1512', a first engaging portion 1514' and a second section 1513' arranged in sequence. The first engaging portion 1514' is movably disposed at the second spindle 118. The protruding portion 1511 is disposed at the first section 1512'. The pressing element 153' abuts against the second section 1513'. The second resilient element 152' is a C-shaped element with one end defined as a second engaging portion 1521 disposed at the third spindle 119. The C-shaped element has the other end connected to the second section 1513'.

Referring to FIG. 7, to put the light-emitting unit 130' in the switch panel 110', the user inserts the light-emitting unit 130' into the receiving chamber 111 through the second through hole 113, keeps pushing the light-emitting unit 130' until the positioning recess 131 gets close to the protruding portion 1511; meanwhile, the second resilient element 152' exerts a resilience restoring force on the second section 1513' of the engaging element 151', such that the engaging element 151' rotates about the second spindle 118 in a third direction C (that is, clockwise as shown in FIG. 7) and the protruding portion 1511 is engaged with and fixed to the positioning recess 131. As a result, second end surface 133 of the light-emitting unit 130' abuts against and presses against the at least a first resilient element 115, such that the first end surface 132 is flush with the second through hole 113 of the switch panel 110', thereby preventing the first end surface 132 from protruding from the second through hole 113. At this point in time, the light-emitting unit 130' has got fixed to the switch panel 110'.

Conversely, to take out the light-emitting unit 130', the user has to press the pressing element 153' to cause the pressing element 153' to abut against the second section 1513' of the engaging element 151', such that the engaging element 151' rotates about the second spindle 118 in a fourth direction D (that is, anticlockwise as shown in FIG. 7); meanwhile, the second resilient element 152' is connected to the second section 1513' and thus bends and deforms to thereby disconnect, together with the protruding portion 1511 of the engaging element 151', from the positioning recess 131. Also, under a resilience restoring force exerted by the at least a first resilient element 115, the light-emitting unit 130' protrudes from the second through hole 113 in a manner shown in FIG. 8, thereby allowing the user to withdraw the light-emitting unit 130' from the switch panel 110' directly.

Figure 9:
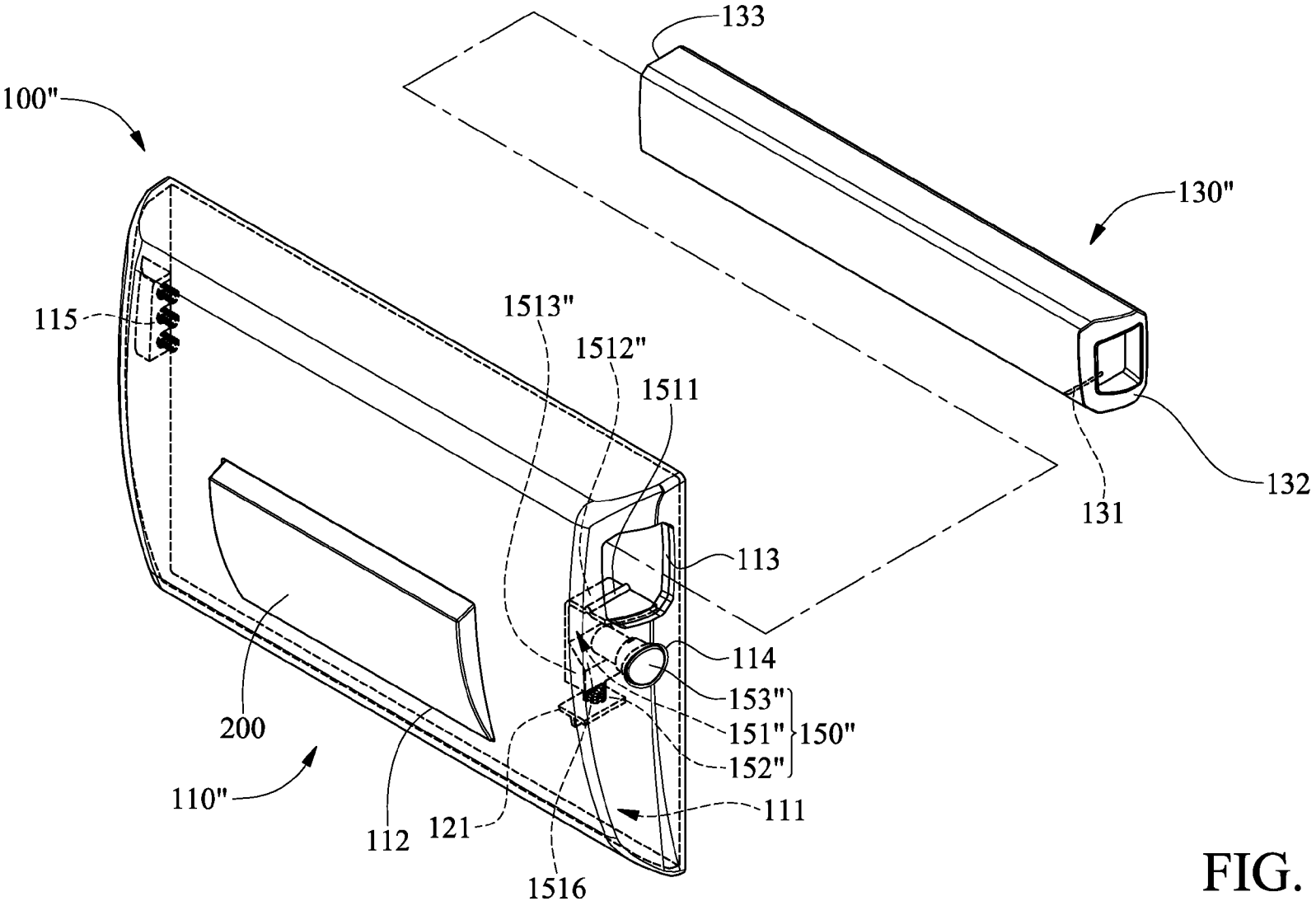
FIG. 9 is an exploded view of a switch illumination device positioned outside a switch according to a third specific embodiment of the present invention.
Figure 10:
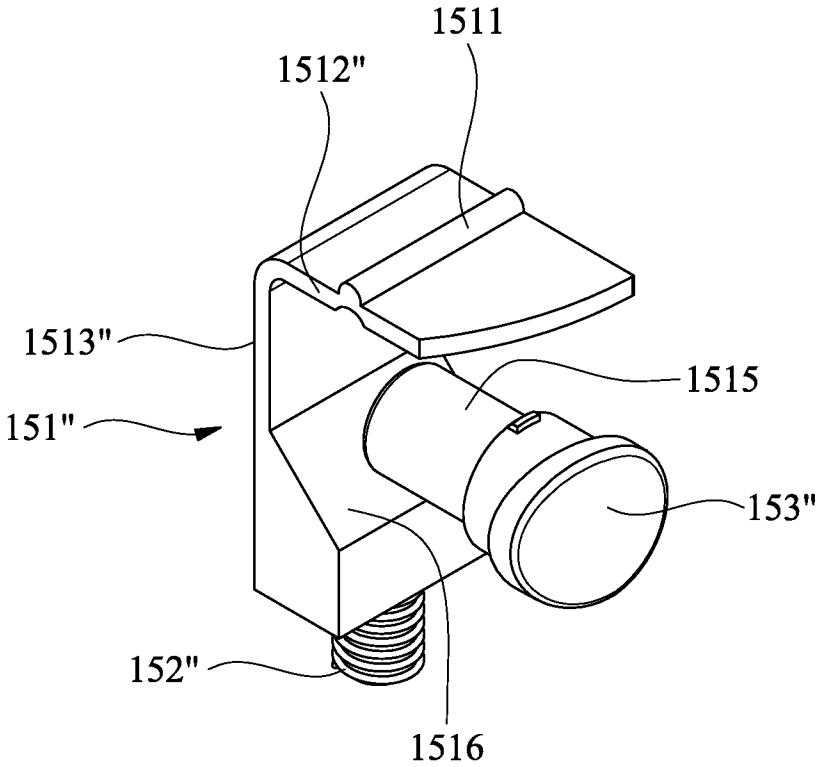
FIG. 10 is a perspective view of a fastening and unfastening structure of the switch illumination device according to the third specific embodiment of the present invention.
Figure 11:
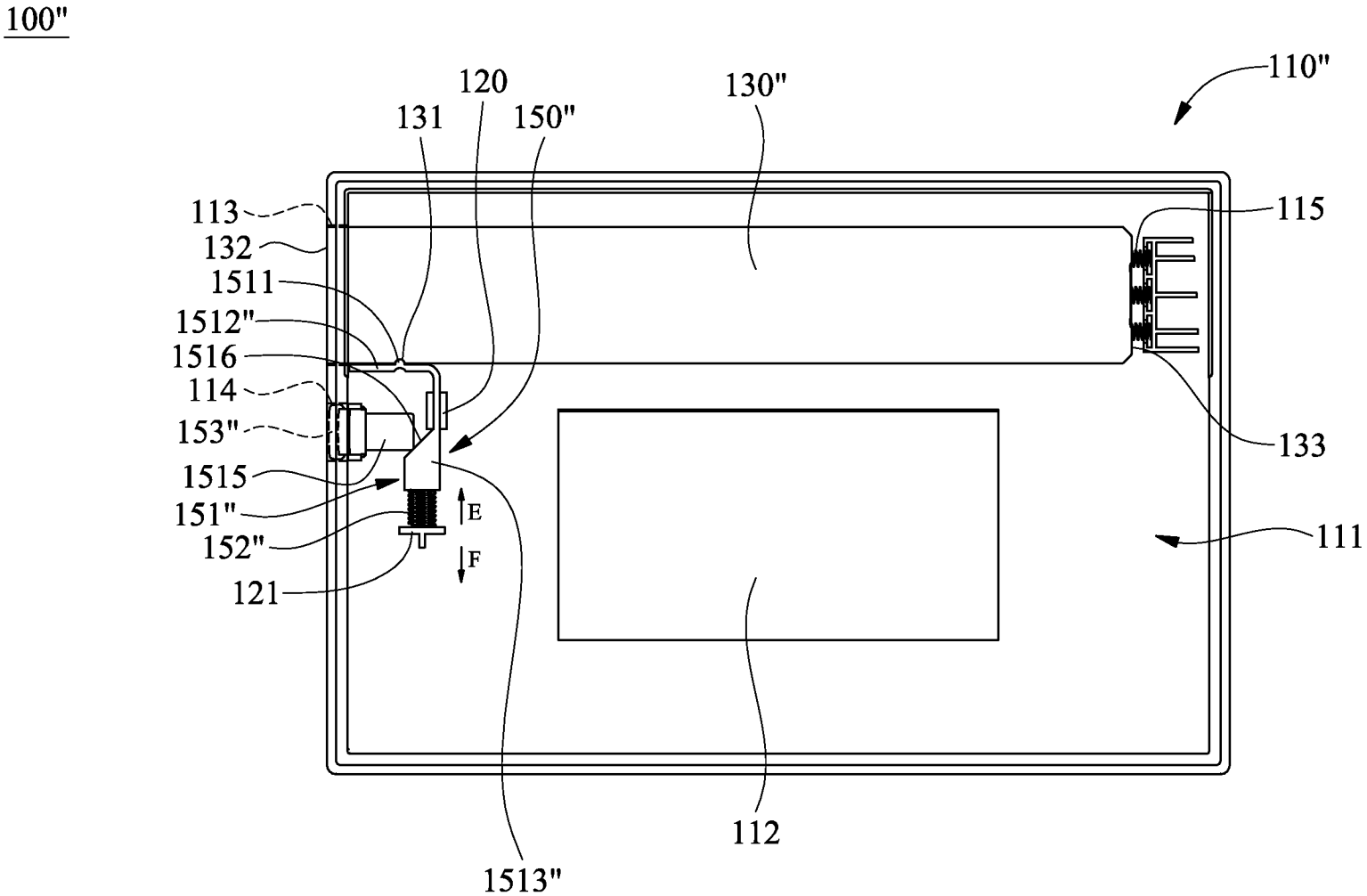
FIG. 11 is a schematic view of operation of the switch illumination device according to the third specific embodiment of the present invention.
Figure 12:
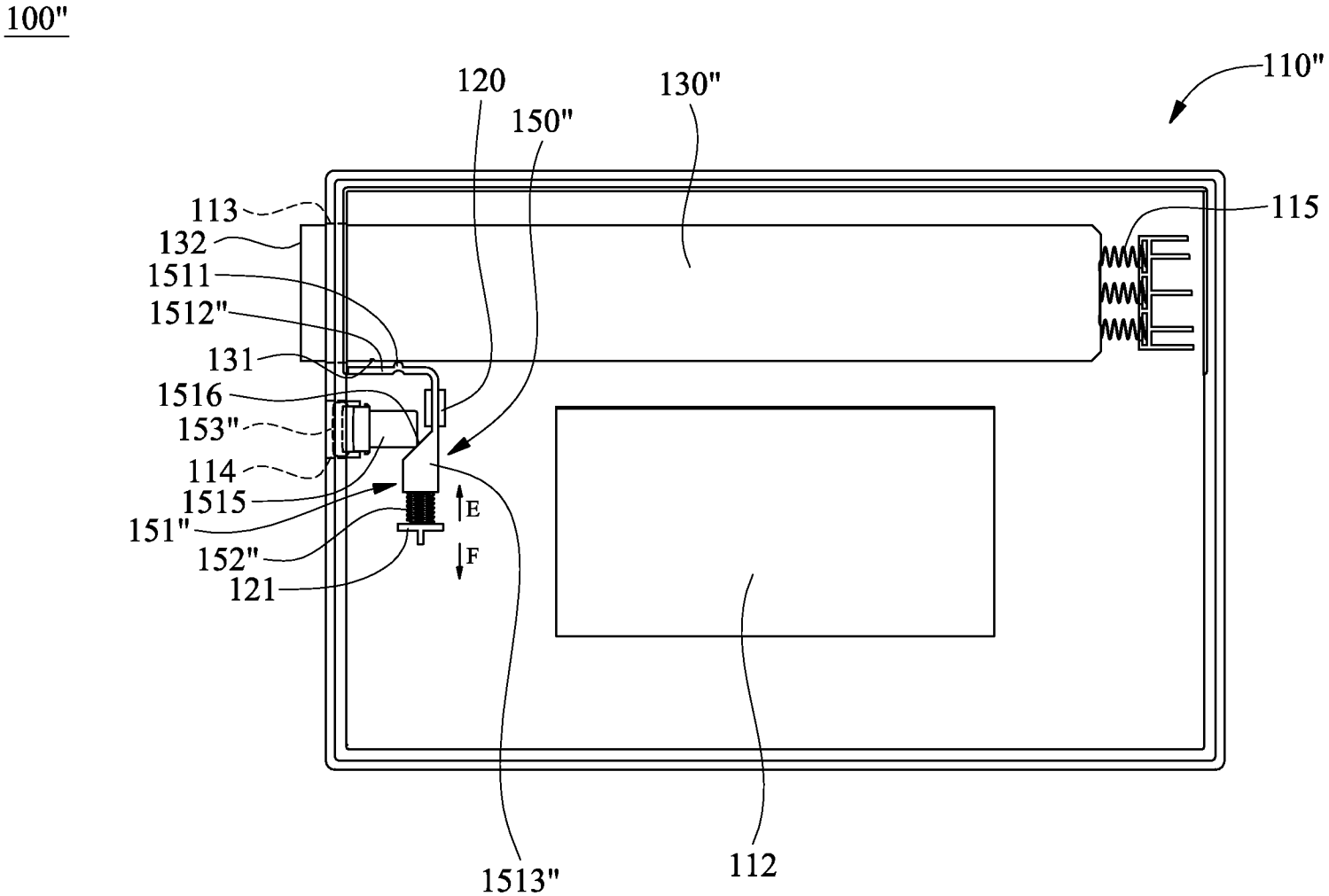
FIG. 12 is a schematic view of operation of the switch illumination device according to the third specific embodiment of the present invention.

Referring to FIG. 9 through FIG. 12, there are shown in FIG. 9 an exploded view of a switch illumination device positioned outside a switch according to a third specific embodiment of the present invention, in FIG. 10 a perspective view of a fastening and unfastening structure of the switch illumination device according to the third specific embodiment of the present invention, and in FIG. 11 and FIG. 12 schematic views of operation of the switch illumination device according to the third specific embodiment of the present invention. Referring to the above drawings, a switch illumination device 100" comprises a switch panel 110", a light-emitting unit 130", and a fastening and unfastening structure 150". The fastening and unfastening structure 150" has an engaging element 151", a second resilient element 152", and a pressing element 153".

In this embodiment, the fastening and unfastening structure 150" is disposed below the light-emitting unit 130", and the positioning recess 131 is disposed below and lateral to the light-emitting unit 130". The receiving chamber 111 has therein a second stop portion 120 and a third stop portion 121. The engaging element 151" is divided into a first section 1512" and a second section 1513". The first section 1512" and the second section 1513" together have a 7-shaped appearance. The protruding portion 1511 is disposed at the first section 1512". The second section 1513" has a surface defined as an inclined surface 1516. The second section 1513" has another surface movably abutting against the second stop portion 120. The pressing element 153" movably abuts against the inclined surface 1516. The second resilient element 152" is connected between the second section 1513" and the third stop portion 121.

Referring to FIG. 11, to put the light-emitting unit 130" in the switch panel 110", the user inserts the light-emitting unit 130" into the receiving chamber 111 through the second through hole 113, keeps pushing the light-emitting unit 130" until the positioning recess 131 gets close to the protruding portion 1511; meanwhile, the second resilient element 152" exerts a resilience restoring force on the engaging element 151" to cause the engaging element 151" to move in a fifth direction E (that is, upward as shown in FIG. 11), such that the protruding portion 1511 is engaged with and fixed to the positioning recess 131. As a result, the second end surface 133 of the light-emitting unit 130" abuts against and presses against the at least a first resilient element 115, whereas the first end surface 132 is flush with the second through hole 113 of the switch panel 110", so as to prevent the first end surface 132 from protruding from the second through hole 113 in a manner shown in FIG. 11. At this point in time, the light-emitting unit 130" has got fixed to the switch panel 110".

Conversely, to take out the light-emitting unit 130", the user has to press the pressing element 153" to cause the pressing element 153" to abut against the inclined surface 1516 of the engaging element 151", such that the pressing element 153" and the inclined surface 1516 slide toward each other to thereby cause the engaging element 151" to move in a sixth direction F (that is, downward as shown in FIG. 11). Hence, due to the position and the angle of inclination of the inclined surface 1516, the engaging element 151" moves in a direction perpendicular to the direction in which the pressing element 153" presses. Furthermore, the engaging element 151" presses against the second resilient element 152", and the protruding portion 1511 of the engaging element 151" disconnects from the positioning recess 131; meanwhile, under a resilience restoring force of the at least a first resilient element 115, the light-emitting unit 130" protrudes from the second through hole 113 in a manner shown in FIG. 12, thereby allowing the user to withdraw the light-emitting unit 130" from the switch panel 110" directly.

Furthermore, in this embodiment, the connection portion 1515 is disposed on the pressing element 153".

Also, the angle of inclination and position of the inclined surface 1516 are not intended to be limited by this embodiment and the accompanying drawing but can be changed as needed in accordance with the movement required for the engaging element 151" to be engaged with and fixed to the positioning recess 131.

In conclusion, a switch illumination device of the present invention is characterized by a fastening and unfastening structure whereby a light-emitting unit is coupled to switch panel. Hence, the light-emitting unit can not only be fixed to the switch panel but also be removed therefrom, thereby effectuating nocturnal illumination, emergency illumination, and mobile illumination.

The present invention is disclosed above by preferred embodiments. However, persons skilled in the art should understand that the preferred embodiments are illustrative of the present invention only, but should not be interpreted as restrictive of the scope of the present invention. Hence, all equivalent modifications and replacements made to the aforesaid embodiments should fall within the scope of the present invention. Accordingly, the legal protection for the present invention should be defined by the appended claims.

What is claimed is:

1. A switch illumination device positioned outside a switch, the switch illumination device comprising:

a switch panel having a receiving chamber, a first through hole, a second through hole, a third through hole, and at least a first resilient element, the at least a first resilient element being fixed inside the receiving chamber, and the switch being exposed from the switch panel through the first through hole;

a light-emitting unit movably disposed inside the receiving chamber and having a positioning recess, a first end surface, and a second end surface opposing the first end surface, the second end surface abutting against the at least a first resilient element, the first end surface being exposed from the switch panel through the second through hole, and the positioning recess being disposed between the first end surface and the second end surface; and a fastening and unfastening structure disposed at the receiving chamber and having an engaging element, a second resilient element, and a pressing element, the engaging element having a protruding portion disposed at the positioning recess, the second resilient element being connected between the switch panel and the engaging element, and the pressing element abutting against the engaging element and being exposed from the switch panel through the third through hole.

2. The switch illumination device of claim 1, wherein the receiving chamber has therein a first spindle and a first stop portion, the engaging element being divided into a first section, a first engaging portion, and a second section in sequence, the first engaging portion being movably disposed at the first spindle, the protruding portion being disposed at the first section, the pressing element abutting against the second section, and the second resilient element being connected between the first section and the first stop portion.

3. The switch illumination device of claim 1, wherein the receiving chamber has therein a second spindle and a third spindle, the engaging element being divided into a first section, a first engaging portion, and a second section in sequence, the first engaging portion being movably disposed at the second spindle, the protruding portion being disposed at the first section, the pressing element abutting against the second section, the second resilient element being a C-shaped element, the C-shaped element having an end defined as a second engaging portion disposed at the third spindle and having another end connected to the second section.

4. The switch illumination device of claim 1, wherein the receiving chamber has therein a second stop portion and a third stop portion, the engaging element being divided into a first section and a second section, the protruding portion being disposed at the first section, the second section having a surface defined as an inclined surface and having another surface movably abutting against the second stop portion, the pressing element movably abutting against the inclined surface, and the second resilient element being connected between the second section and the third stop portion.

* * * * *